US007992945B2

(12) United States Patent
Hall et al.

(10) Patent No.: US 7,992,945 B2
(45) Date of Patent: Aug. 9, 2011

(54) HOLLOW PICK SHANK

(75) Inventors: David R. Hall, Provo, UT (US); Ronald B. Crockett, Payson, UT (US); Scott Dahlgren, Alpine, UT (US); Jeff Jepson, Spanish Fork, UT (US)

(73) Assignee: Schlumberger Technology Corporation, Houston, TX (US)

( * ) Notice: Subject to any disclaimer, the term of this patent is extended or adjusted under 35 U.S.C. 154(b) by 305 days.

(21) Appl. No.: 11/871,722

(22) Filed: Oct. 12, 2007

(65) Prior Publication Data

US 2008/0036269 A1 Feb. 14, 2008

Related U.S. Application Data

(63) Continuation-in-part of application No. 11/844,586, filed on Aug. 24, 2007, now Pat. No. 7,600,823, which is a continuation-in-part of application No. 11/829,761, filed on Jul. 27, 2007, now Pat. No. 7,722,127, which is a continuation-in-part of application No. 11/773,271, filed on Jul. 3, 2007, which is a continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, said application No. 11/829,761 is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(51) Int. Cl.
*E21C 35/197* (2006.01)

(52) U.S. Cl. ..... 299/111; 299/105; 299/106

(58) Field of Classification Search ..... 299/105, 299/106, 111, 113
See application file for complete search history.

(56) References Cited

U.S. PATENT DOCUMENTS 1,899,343 A 2/1933 Mackey
(Continued)

FOREIGN PATENT DOCUMENTS

DE 3307910 9/1984
(Continued)

OTHER PUBLICATIONS

International Search Report for PCT/US08/69231, mailed Nov. 18, 2008.

(Continued)

*Primary Examiner* — John Kreck
(74) *Attorney, Agent, or Firm* — Holme Roberts & Owen LLP

(57) ABSTRACT

In one aspect of the invention, a degradation pick comprises a bolster disposed intermediate a shank and an impact tip. The shank comprises an outer diameter and first and second ends. The shank is coupled to the bolster through the first end and the second end is adapted for insertion into a central bore of a holder attached to a driving mechanism. The shank comprises a hollow portion disposed within the outer diameter and between the first and second ends. The hollow portion may comprise an opening that is disposed in the second end. In some embodiments the hollow portion may comprise a length that is at least as great as the outer diameter.

20 Claims, 10 Drawing Sheets

U.S. PATENT DOCUMENTS 2,004,315 A 6/1935 Fean
2,124,438 A 7/1938 Struk
3,254,392 A 6/1966 Novkov
3,342,532 A * 9/1967 Krekeler ..... 299/107
3,397,012 A 8/1968 Krekeler
3,512,838 A 5/1970 Kniff
3,655,244 A 4/1972 Swisher
3,746,396 A 7/1973 Radd
3,807,804 A 4/1974 Kniff
3,830,321 A 8/1974 McKenry
3,932,952 A 1/1976 Helton et al.
3,945,681 A 3/1976 White
4,005,914 A 2/1977 Newman
4,006,936 A 2/1977 Crabiel
4,098,362 A 7/1978 Bonnice
4,109,737 A 8/1978 Bovenkerk
4,156,329 A 5/1979 Daniels
4,199,035 A 4/1980 Thompson
4,201,421 A 5/1980 Den Besten et al.
4,247,150 A 1/1981 Wrulich et al.
4,251,109 A * 2/1981 Roepke ..... 299/12
4,268,089 A 5/1981 Spence et al.
4,277,106 A 7/1981 Sahley
4,289,211 A 9/1981 Lumén
4,439,250 A 3/1984 Acharya
4,465,221 A 8/1984 Schmidt
4,484,644 A 11/1984 Cook et al.
4,484,783 A 11/1984 Emmerich
4,489,986 A 12/1984 Dziak
4,537,448 A 8/1985 Ketterer
4,627,665 A 12/1986 Ewing et al.
4,660,890 A 4/1987 Mills
4,678,237 A 7/1987 Collin
4,682,987 A 7/1987 Brady et al.
4,684,176 A 8/1987 Den Besten et al.
4,688,856 A 8/1987 Elfgen
4,725,098 A 2/1988 Beach
4,728,153 A 3/1988 Ojanen et al.
4,729,603 A 3/1988 Elfgen
4,765,686 A 8/1988 Adams
4,765,687 A 8/1988 Parrott
4,776,862 A 10/1988 Wiand
4,836,614 A 6/1989 Ojanen
4,850,649 A 7/1989 Beach et al.
4,880,154 A 11/1989 Tank
4,932,723 A 6/1990 Mills
4,940,288 A 7/1990 Stiffler
4,944,559 A 7/1990 Sionnet et al.
4,951,762 A 8/1990 Lundell
5,007,685 A 4/1991 Beach et al.
5,011,515 A 4/1991 Frushour
5,018,793 A 5/1991 Den Besten
5,106,166 A 4/1992 O'Neill
5,112,165 A 5/1992 Hedlund
5,119,714 A 6/1992 Scott et al.
5,141,289 A 8/1992 Stiffler
5,154,245 A 10/1992 Waldenstrom et al.
5,186,892 A 2/1993 Pope
5,251,964 A 10/1993 Ojanen
5,303,984 A 4/1994 Ojanen
5,332,348 A 7/1994 Lemelson
5,374,111 A 12/1994 Den Besten et al.
5,415,462 A 5/1995 Massa et al.
5,417,475 A 5/1995 Graham et al.
5,447,208 A 9/1995 Lund
5,503,463 A 4/1996 Ojanen
5,535,839 A 7/1996 Brady
5,542,993 A 8/1996 Rabinkin
5,653,300 A 8/1997 Lund et al.
5,720,528 A 2/1998 Ritchey
5,725,283 A 3/1998 O'Neill
5,730,502 A 3/1998 Montgomery, Jr.
5,738,415 A 4/1998 Parrott
5,738,698 A 4/1998 Kapoor
5,823,632 A 10/1998 Burkett
5,837,071 A 11/1998 Anderson
5,845,547 A 12/1998 Sollami
5,875,862 A 3/1999 Jurewicz et al.
5,884,979 A 3/1999 Latham
5,890,552 A 4/1999 Scott et al.
5,934,542 A 8/1999 Nakamura
5,935,718 A 8/1999 Demo
5,944,129 A 8/1999 Jenson
5,967,250 A 10/1999 Lund et al.
5,992,405 A 11/1999 Sollami
6,006,846 A 12/1999 Tibbitts et al.
6,019,434 A 2/2000 Emmerich
6,044,920 A 4/2000 Massa et al.
6,051,079 A 4/2000 Andersson
6,056,911 A 5/2000 Griffin
6,065,552 A 5/2000 Scott
6,113,195 A 9/2000 Mercier et al.
6,193,770 B1 2/2001 Sung
6,196,636 B1 3/2001 Mills et al.
6,196,910 B1 3/2001 Johnson et al.
6,199,956 B1 3/2001 Kammerer
6,216,805 B1 4/2001 Lays et al.
6,270,165 B1 8/2001 Peay
6,341,823 B1 1/2002 Sollami
6,354,771 B1 3/2002 Bauschulte et al.
6,364,420 B1 4/2002 Sollami
6,371,567 B1 4/2002 Sollami
6,375,272 B1 4/2002 Ojanen
6,419,278 B1 7/2002 Cunningham
6,478,383 B1 11/2002 Ojanen et al.
6,499,547 B2 12/2002 Scott et al.
6,517,902 B2 2/2003 Drake et al.
6,585,326 B2 7/2003 Sollami
6,685,273 B1 2/2004 Sollami
6,692,083 B2 2/2004 Latham
6,702,393 B2 3/2004 Mercier
6,709,065 B2 3/2004 Peay et al.
6,732,914 B2 5/2004 Cadden et al.
6,733,087 B2 * 5/2004 Hall et al. ..... 299/113
6,739,327 B2 5/2004 Sollami
6,758,530 B2 7/2004 Sollami
6,786,557 B2 9/2004 Montgomery, Jr.
6,824,225 B2 11/2004 Stiffler
6,851,758 B2 2/2005 Beach
6,854,810 B2 2/2005 Montgomery, Jr.
6,861,137 B2 3/2005 Griffin et al.
6,863,352 B2 3/2005 Sollami
6,889,890 B2 5/2005 Yamazaki
6,962,395 B2 11/2005 Mouthaan
6,966,611 B1 11/2005 Sollami
6,994,404 B1 2/2006 Sollami
7,094,473 B2 8/2006 Takayama et al.
7,204,560 B2 4/2007 Mercier et al.
7,384,105 B2 6/2008 Hall et al.
7,387,345 B2 6/2008 Hall et al.
7,390,066 B2 6/2008 Hall et al.
7,413,258 B2 8/2008 Hall et al.
2002/0175555 A1 11/2002 Mercier
2003/0141350 A1 7/2003 Noro
2003/0209366 A1 11/2003 McAlvain
2003/0230926 A1 12/2003 Mondy
2003/0234280 A1 12/2003 Cadden
2004/0026983 A1 2/2004 McAlvain
2004/0065484 A1 4/2004 McAlvain
2004/0228694 A1 11/2004 Webb et al.
2005/0159840 A1 7/2005 Lin
2005/0173966 A1 8/2005 Mouthaan
2006/0237236 A1 10/2006 Sreshta et al.
2006/0261663 A1 11/2006 Sollami
2007/0013224 A1 * 1/2007 Stehney ..... 299/104

FOREIGN PATENT DOCUMENTS

DE 3500261 7/1986
DE 3818213 11/1989
DE 4039217 6/1992
DE 19821147 11/1999
DE 10163717 5/2003

| | | | |
|---|---|---|---|
| EP | 0295151 | | 6/1988 |
| EP | 0412287 | | 7/1990 |
| EP | 1574309 | | 9/2005 |
| GB | 2004315 | | 3/1979 |
| GB | 2037223 | | 11/1979 |
| JP | 5280273 | A | 3/1992 |
| JP | 2002-081524 | | 3/2002 |

OTHER PUBLICATIONS

Written Opinion for PCT/US08/69231, mailed Nov. 18, 2008.

International Preliminary Report on Patentability for PCT/US08/69231, mailed Jan. 5, 2010.

* cited by examiner

HOLLOW PICK SHANK

CROSS REFERENCE TO RELATED APPLICATIONS

This application is a continuation-in-part of application Ser. No. 11/844,586, filed on Aug. 24, 2007, now U.S. Pat. No. 7,600,823, which is a continuation-in-part of application Ser. No. 11/829,761, filed on Jul. 27, 2007, now U.S. Pat. No. 7,722,127, which is a continuation-in-part of application Ser. No. 11/773,271, filed on Jul. 3, 2007, which is a continuation-in-part of application Ser. No. 11/766,903, filed on Jun. 22, 2007, which is a continuation of application Ser. No. 11/766,865, filed on Jun. 22, 2007, which is a continuation-in-part of application Ser. No. 11/742,304, filed on Apr. 30, 2007, now U.S. Pat. No. 7,475,948, which is a continuation of application Ser. No. 11/742,261, filed on Apr. 30, 2007, now U.S. Pat. No. 7,469,971, which is a continuation-in-part of U.S. patent application Ser. No. 11/464,008, filed on Aug. 11, 2006, now U.S. Pat. No. 7,338,135, which is a continuation-in-part of application Ser. No. 11/463,998, filed on Aug. 11, 2006, now U.S. Pat. No. 7,384,105, which is a continuation-in-part of application Ser. No. 11/463,990, filed on Aug. 11, 2006, now U.S. Pat. No. 7,320,505, which is a continuation-in-part of application Ser. No. 11/463,975, filed on Aug. 11, 2006, now U.S. Pat. No. 7,445,294, which is a continuation-in-part of application Ser. No. 11/463,962, filed on Aug. 11, 2006, now U.S. Pat. No. 7,413,256, which is a continuation-in-part of application Ser. No. 11/463,953, filed on Aug. 11, 2006, now U.S. Pat. No. 7,464,993. Said application Ser. No. 11/829,761 is a continuation-in-part of application Ser. No. 11/695,672, filed on Apr. 3, 2007, now U.S. Pat. No. 7,396,086, which is a continuation-in-part of application Ser. No. 11/686,831, filed on Mar. 15, 2007, now U.S. Pat. No. 7,568,770. All of these applications are herein incorporated by reference for all that they contain.

BACKGROUND OF THE INVENTION

Efficient degradation of materials is important to a variety of industries including the asphalt, mining, construction, drilling, and excavation industries. In the asphalt industry, pavement may be degraded using picks, and in the mining industry, picks may be used to break minerals and rocks. Picks may also be used when excavating large amounts of hard materials. In asphalt milling, a drum supporting an array of picks may rotate such that the picks engage a paved surface causing it to break up. Examples of degradation assemblies from the prior art are disclosed in U.S. Pat. No. 6,824,225 to Stiffler, US Pub. No. 20050173966 to Mouthaan, U.S. Pat. No. 6,692,083 to Latham, U.S. Pat. No. 6,786,557 to Montgomery, Jr., U.S. Pat. No. 3,830,321 to McKenry et al., US. Pub. No. 20030230926, U.S. Pat. No. 4,932,723 to Mills, US Pub. No. 20020175555 to Merceir, U.S. Pat. No. 6,854,810 to Montgomery, Jr., U.S. Pat. No. 6,851,758 to Beach, which are all herein incorporated by reference for all they contain.

The picks typically have a tungsten carbide tip, which may last less than a day in hard milling operations. Consequently, many efforts have been made to extend the life of these picks. Examples of such efforts are disclosed in U.S. Pat. No. 4,944,559 to Sionnet et al., U.S. Pat. No. 5,837,071 to Andersson et al., U.S. Pat. No. 5,417,475 to Graham et al., U.S. Pat. No. 6,051,079 to Andersson et al., and U.S. Pat. No. 4,725,098 to Beach, U.S. Pat. No. 6,733,087 to Hall et al., U.S. Pat. No. 4,923,511 to Krizan et al., U.S. Pat. No. 5,174,374 to Hailey, and U.S. Pat. No. 6,868,848 to Boland et al., all of which are herein incorporated by reference for all that they disclose.

BRIEF SUMMARY OF THE INVENTION

In one aspect of the invention, a degradation pick comprises a bolster disposed intermediate a shank and an impact tip. The shank comprises an outer diameter and first and second ends. The shank is coupled to the bolster through the first end and the second end is adapted for insertion into a central bore of a holder attached to a driving mechanism. The shank comprises a hollow portion disposed within the outer diameter and between the first and second ends. The hollow portion may comprise an opening that is disposed in the second end. In some embodiments the hollow portion may comprise a length that is at least as great as the outer diameter. The outer diameter may be between 0.5 and 2 inches.

The impact tip of the degradation pick may comprise an impact surface with a hardness greater than 4000 HK. The impact surface may comprise a material selected from the group consisting of diamond, polycrystalline diamond, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, cemented metal carbide, chromium, titanium, aluminum, tungsten, or combinations thereof.

A steel body may be disposed intermediate the first end of the shank and the bolster of the degradation pick. The steel body may be brazed to the bolster. The bolster may comprise a cemented metal carbide. In some embodiments the bolster may be a carbide core that is press fit into the steel body. Other embodiments may comprise a first end of the shank that is press fit into the bolster. The second end of the shank may be disposed within a central bore of a holder. The central bore may comprise a closed end proximate a driving mechanism.

A lubricant reservoir may be disposed at least partially within the hollow area of the shank of the degradation pick. The lubricant reservoir may be pressurized. The lubricant reservoir may comprise a pressurization mechanism selected from the group consisting of springs, coiled sprigs, foam, closed-cell foam, compressed gas, wave springs, and combinations thereof. An O-ring may be disposed proximate a distal surface of the holder and may substantially retain a lubricant within the holder. The O-ring may be disposed intermediate the bolster and the distal surface. In some embodiments the O-ring may be disposed intermediate the shank and an inner surface of the bore.

The degradation pick may be part of an asphalt milling machine, a trenching machine, a coal mining machine, or combinations thereof.

DETAILED DESCRIPTION OF THE INVENTION AND THE PREFERRED EMBODIMENT

Figure 1:
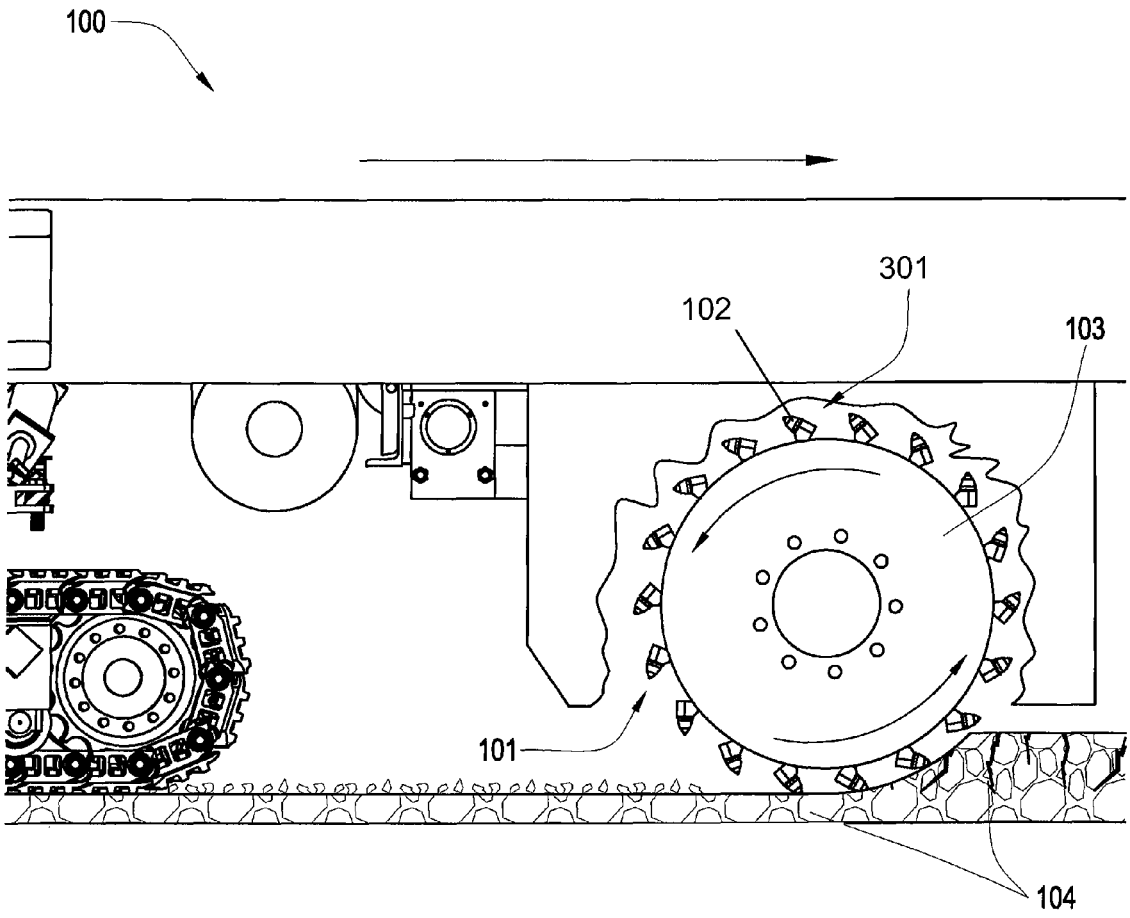
FIG. 1 is a cross-sectional diagram of an embodiment of a recycling machine.

FIG. 1 is a cross-sectional diagram of an embodiment of a plurality of high-impact resistant degradation picks 101 attached to a driving mechanism 103, such as a rotating drum that is connected to the underside of a pavement recycling machine 100. The recycling machine 100 may be a cold planer used to degrade man-made formations such as a paved surface 104 prior to the placement of a new layer of pavement. Picks 101 may be attached to the driving mechanism bringing the picks 101 into engagement with the formation. A holder 102 may be inserted into a block 301 that is attached to the driving mechanism 103, with the degradation pick 101 in turn being inserted into the holder 102. The holder 102 and block 301 assembly may hold the degradation pick 101 at an angle offset from the direction of rotation, such that the pick 101 engages the pavement at a preferential angle. Each pick 101 may be designed for high-impact resistance and long life while milling the paved surface 104.

Figure 2:
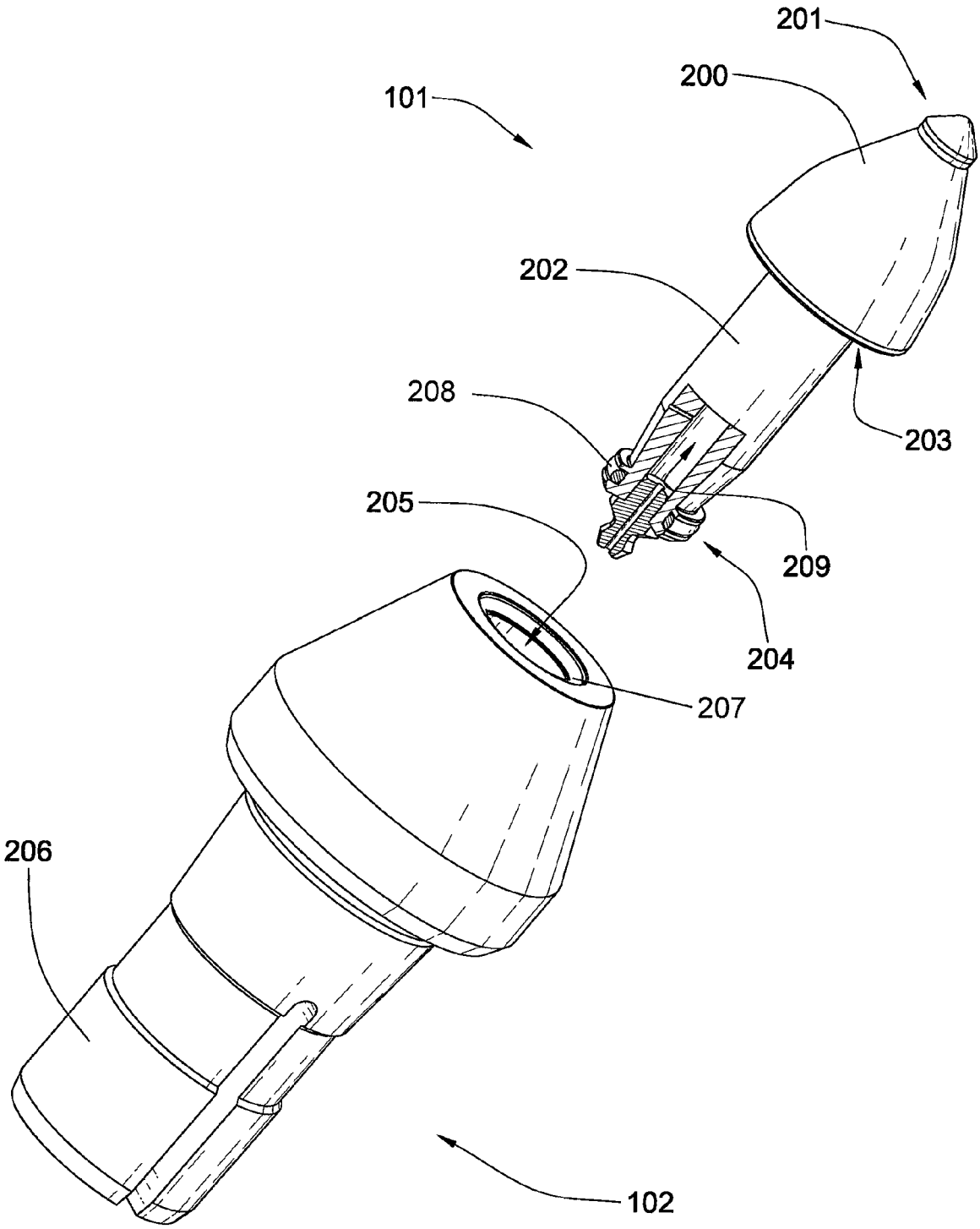
FIG. 2 is an exploded perspective diagram of an embodiment of a high-impact resistant pick and an embodiment of a holder.

Referring now to FIG. 2, the degradation pick 101 comprises a bolster 200 disposed intermediate an impact tip 201 and a shank 202. The shank comprises first and second ends 203, 204, and can be coupled to the bolster 200 through its first end 203. The second end 204 of the shank is adapted for insertion into a central bore 205 of the holder 102. In the representative embodiment of the degradation pick 101 illustrated in FIG. 2, the holder 102 can comprises an extension element 206. An O-ring 208 is disposed on the shank 202 proximate the second end 204. Another O-ring 207 may be disposed within the central bore 205 of the holder 102. When the second end 204 of the shank 202 is inserted into the central bore 205, both O-rings 207, 208 may be disposed around the shank 202. A cut-out of FIG. 2 also discloses an interior hollow portion 209 of the shank 202.

Figure 3:
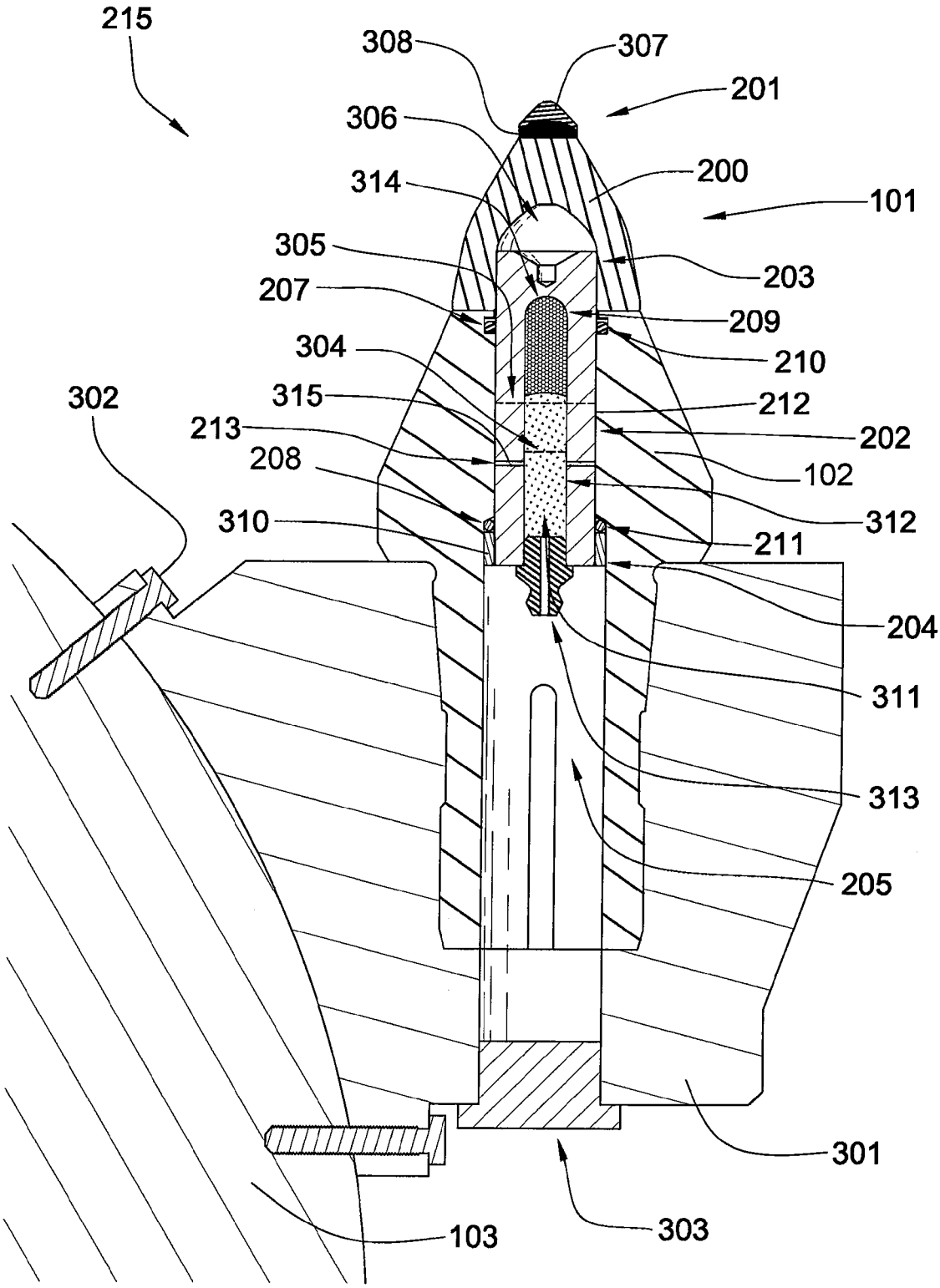
FIG. 3 is a cross-sectional diagram of an embodiment of a high-impact resistant pick.

Referring now to FIG. 3, a cross-sectional diagram discloses a degradation assembly 215 that includes the degradation pick 101 with the second end 204 of the pick shank 202 disposed within the central bore 205 of the holder 102. In turn, the holder 102 is disposed within the block 301 that is attached to a degradation drum 103 by a plurality of bolts 302 or welds. In one aspect the block 301 can include a removable cap 303 proximate the driving mechanism 103 which may be press fit into the block 301. The removable cap 303 can provide a closed end proximate the driving mechanism 103. In some embodiments the closed end may not be removable.

As can be seen in FIG. 3, the shank 202 of the degradation pick 101 comprises inner and outer diameters 304, 305, with the material of the shank 202 being disposed intermediate the inner and outer diameters 304, 305. In other words, the shank 202 can include a hollow portion 209 within the outer diameter 305 between the first and second ends 203, 204. In some aspects the hollow portion 209 may be completely filled or partially filled by one or more materials, while in other aspects the hollow portion 209 may not be filled with any material. The outer diameter 305 of the shank 202 may range between about 0.5 and 2 inches, with one exemplary embodiment having an outer diameter of about 0.75 inches.

In one aspect the bolster 200 of the degradation pick 101 can comprise tungsten carbide. The bolster 200 may also comprise one or more cemented metal carbides including carbides of tungsten, titanium, tantalum, molybdenum, niobium, cobalt and combinations thereof.

The impact tip 201 of the degradation pick 101 comprises an impact surface 307 with a hardness greater than 4000 HK. The impact surface 307 may comprise a material selected from the group consisting of diamond, polycrystalline diamond, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, cemented metal carbide, chromium, titanium, aluminum, tungsten, or combinations thereof. In some embodiments the impact surface 307 may be sintered onto a carbide substrate 308. The carbide substrate 308 may be brazed to the bolster 200 with a high-strength braze.

The braze material may comprise a melting temperature from 700 to 1200 degrees Celsius; with one representative embodiment having a melting temperature ranging from about 800 to about 970 degrees Celsius. The braze material may comprise silver, gold, copper nickel, palladium, boron, chromium, silicon, germanium, aluminum, iron, cobalt, manganese, titanium, tin, gallium, vanadium, phosphorus, molybdenum, platinum, or combinations thereof. The braze material may also comprise 30 to 62 weight percent palladium, with one representative embodiment ranging from about 40 to 50 weight percent palladium. Additionally, the braze material may comprise 30 to 60 weight percent nickel, and 3 to 15 weight percent silicon; preferably the braze material may comprise 47.2 weight percent nickel, 46.7 weight percent palladium, and 6.1 weight percent silicon.

Active cooling during brazing may also be utilized during the manufacture of some embodiments, since the heat from brazing may leave some residual stress in the bond between the carbide substrate 308 and the impact surface 307. The farther away the impact surface 307 is from the braze interface, the less thermal damage is likely to occur during brazing. Increasing the distance between the brazing interface and the impact surface 307, however, may increase the moment on the carbide substrate 308 and increase stresses at the brazing interface upon impact.

As further shown in FIG. 3, the first end 203 of the shank 202 can be press fit into a recess 306 in the bolster 200. In various aspects the first end 203 of the shank 202 may comprise a Morse taper of size 0 to size 7, a Brown taper size 1 to size 18, a Sharpe taper size 1 to 18, an R8 taper, a Jacobs taper size 0 to size 33, a Jamo taper size 2 to 20, a NMTB taper size 25 to 60, or modifications or combinations thereof. In another aspects the first end 203 may comprise no taper. Alternatively, the first end 203 may also be connected to the bolster 200 by a mechanical fit such as press fits and threads, or by bonds such as a brazes and welds.

The shank 202 may comprise a hard material such as steel, hardened steel, or other materials of similar hardness. Furthermore, the material forming the shank 202 may be work-hardened in order to provide resistance to cracking or stress fractures due to forces exerted on the pick 101 by the paved surface 104 or the holder 102. The shank 202 may be work-hardened by shot-peening the shank, chrome plating the shank, enriching the shank with nitrogen and/or carbon, or other methods of work-hardening.

The second end 204 of the shank 202 may be rotatably held in the holder 102 by a retaining ring 310 adapted to fit in an inset portion of the holder 102, such that the degradation pick 101 is allowed to rotate within the holder 102 and the pick 101 and holder 102 may wear generally evenly. Additionally, the first end 203 of the shank 202 may also include one or more recesses or grooves to provide compliance to the first end 203. A sleeve (not shown) may be also disposed loosely around the shank 202 and placed within the holder 102, which may allow the sleeve to retain the shank 202 while still allowing the shank 202 to rotate within the holder 102. In another aspect the shank 202 may also include a spring (not shown) adapted to pull down on the shank 202. This may provide the benefit of keeping the degradation pick 101 snugly secured within the central bore 205 of the holder 102.

A lubricant 311 may be inserted into the central bore 205 of the holder 102 so that the lubricant may be disposed intermediate the outer surfaces of the shank 202 and the inter surfaces of the holder 102. In the illustrated embodiment a lubricant reservoir 312 is disposed entirely within the hollow portion 209 of the shank 202. The lubricant reservoir may comprise a lubricant selected from the group consisting of grease, petroleum products, vegetable oils, mineral oils, graphite, hydrogenated polyolefins, esters, silicone, fluorocarbons, molybdenum disulfide, and combinations thereof. A filling port 313 is disposed proximate the second end 204 of the shank and to allow lubricant 311 to be inserted into the reservoir 312, and can also include a check valve to prevent the lubricant 311 from exiting the reservoir 312 through the second end 204.

In FIG. 3 the lubricant reservoir 312 is pressurized by a pressurization mechanism 314, such as closed-cell foam When lubricant 311 is added to the reservoir 312, the closed-cell foam may be forced to decrease its volume in order to match the pressure exerted on the foam by the lubricant 311, thereby allowing the lubricant 311 to be inserted. After the lubricant 311 is inserted into the hollow portion 209 of the shank 202, the pressurization mechanism 314 may apply a substantially constant pressure on the lubricant 311. In some embodiments of the invention the lubricant reservoir 312 may comprise a pressurization mechanism 314 selected from the group consisting of springs, coiled springs, foam, closed-cell foam, compressed gas, wave springs, and combinations thereof.

In the present embodiment the lubricant reservoir 312 includes one or more generally tubular lubricant exit pathways 315 that extend radially outward from the inner diameter 304 to the outer diameter 305. The exit pathways 315 may connect to the central bore 205 at a passage opening 213. The pressure from the pressurization mechanism 314 may force the lubricant 311 through the exit pathways 315 and into a space between the shank 202 and the holder 102. O-rings 207, 208 may be disposed proximate the first and second ends 203, 204 of the shank to form first and second seals 210, 211, respectively. The first and second seals 210, 211 may substantially retain the lubricant 311 between the shank 202 and the holder 102 to decrease friction and allow the pick 101 to rotate more easily. The decreased friction may allow for better wear protection of areas in contact with the holder 102, such as the shank 202 or the base of the bolster 200. An enclosed region 212 may be disposed intermediate the first and second seals 210, 211 and may comprise a volume disposed intermediate the inner surfaces of the holder 102 and the outer surfaces of pick shank 202. In the embodiment illustrated in FIG. 3, the enclosed region is in fluid communication with the pressurized lubricant reservoir 312 via the lubricant exit pathways 315. The lubricant 311 enters the enclosed region 212 though the one or more passage openings 213 disposed intermediate the first and second seals 210, 211 that connect the enclosed region 212 to the hollow portion 209 of the shank 202 via the one or more lubricant exit pathways 315.

Figure 3A:
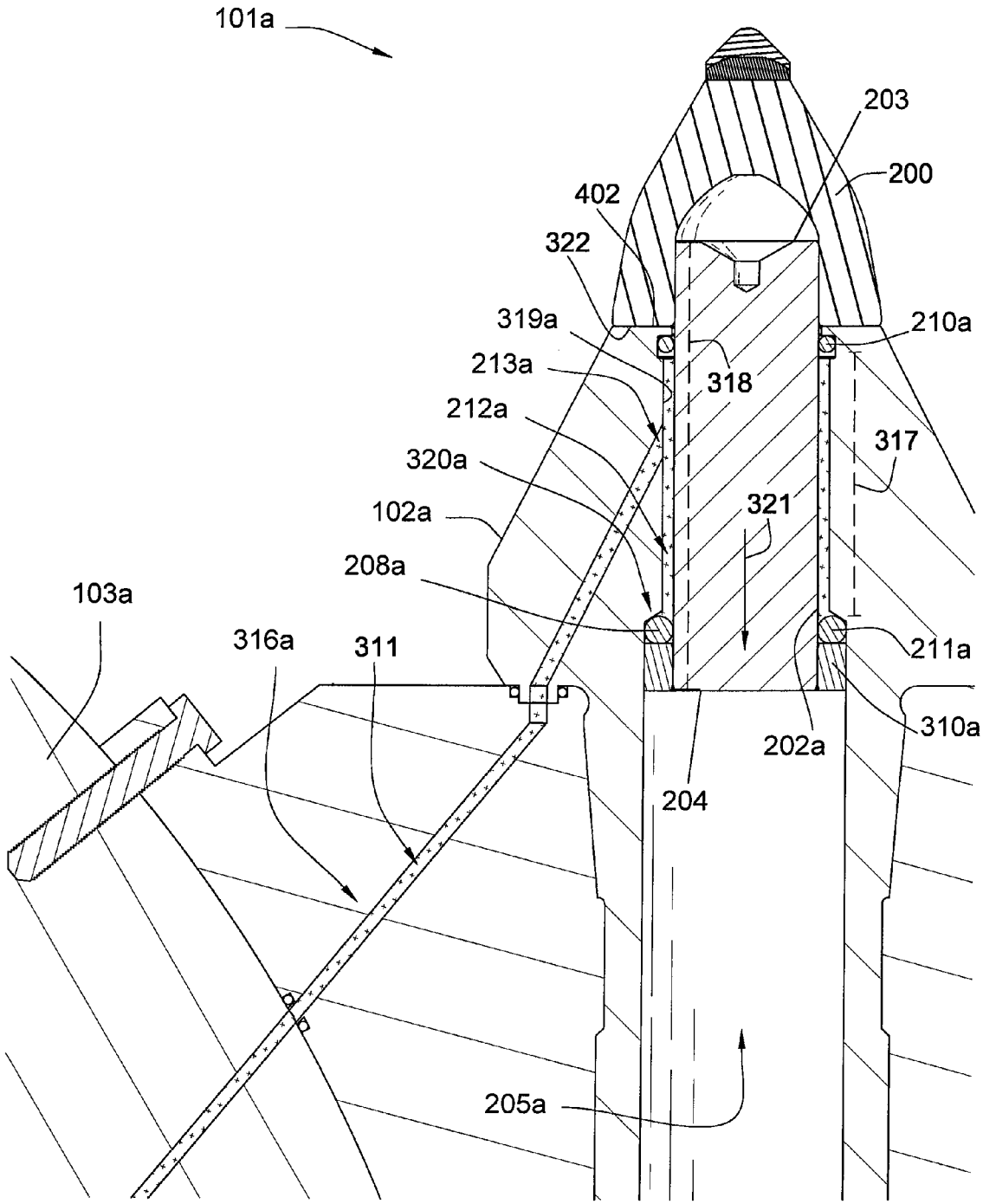
FIG. 3*a* is a cross-sectional diagram of an embodiment of a degradation assembly.

Referring now to another representative embodiment of the degradation pick 101*a* illustrated in FIG. 3*a*, the lubricant 311 may also be provided to the central bore 205*a* of the holder 102*a* from the driving mechanism 103*a*. In embodiments where the driving mechanism 103*a* is a drum, the drum may include a lubricant reservoir (not shown) and a channel 316*a* may be formed in the drum 103*a* which leads from the lubricant reservoir to the holder 102*a*. The lubricant reservoir may be pressurized to force the lubricant 311 through the channel 316*a* and to the passage opening 213*a*. From the passage opening 213*a* the lubricant 311 may enter the enclosed region 212*a* between the shank 202*a* and the holder 102*a* that is disposed in part of the central bore 205*a* of the holder 102*a*. The enclosed region 212*a* may comprise an enclosed length 317 that may extend from the first seal 210*a* to the second seal 211*a*. In some embodiments of the invention the enclosed length 317 may be at least one half a total length 318 of the shank 202*a*. The total length 318 of the shank may extend from the first end 203 to the second end 204. At least one of the first and second seals 210*a*, 211*a* may also be a weeping seal. A weeping seal disposed proximate the bolster 200 may provide the benefit of preventing debris from entering the enclosed region 212*a* while allowing some lubricant 311 to escape to clean the seal.

In FIG. 3*a*, an inside surface 319*a* of the bore 205*a* of the holder 102*a* comprises a tapered edge 320*a* disposed proximate the second end 204 of the shank 202*a*. A retaining ring 310*a* is attached to the second end 204 of the shank 202*a* proximate the tapered edge 320*a* and the second seal 211*a*. The ring 310*a* may be press fit onto the shank 202*a*, or in some embodiments it may be brazed or otherwise bonded to the shank. In FIG. 3*a* the second seal 211*a* is an O-ring 208*a* which can be compressed by the ring 310*a* and the tapered edge 320*a*. In one embodiment the second seal 211*a* may be compressed at least 10% by the ring 310*a* and the tapered edge 320*a*. In another embodiment the second seal 211*a* may be compressed by at least 15% by the ring 310*a* and the tapered edge 320*a*.

When the pressurized lubricant 311 is disposed in the enclosed region 212*a*, the lubricant 311 may exert pressure on the second seal 211*a* and the retaining ring 310*a*. This pressure may exert a force on the degradation pick 101*a* represented by an arrow 321. The force may pull a lower surface 322 of the pick 101*a* towards a distal surface 402 of the holder 102*a*. In some embodiments the pressurized lubricant 311 may maintain substantial contact between the lower surface 322 and the distal surface 402 by maintaining a substantially constant pressure on the retaining ring 310*a*. The force 321 on the pick 101*a* may retain the pick 101*a* in the holder 102*a* while still allowing the pick 101*a* to rotate with respect to the holder 102*a*.

Figure 4:
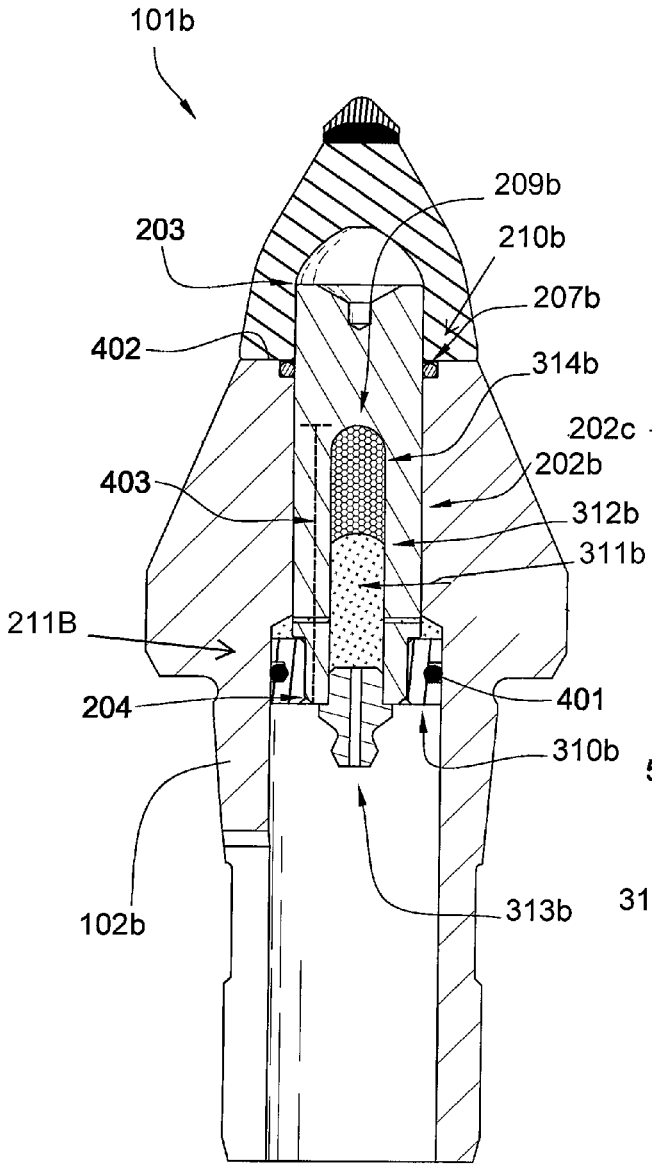
FIG. 4 is a cross-sectional diagram of another embodiment of a high-impact resistant pick.

Referring now to FIG. 4, another embodiment of a degradation pick 101*b* is disclosed in a holder 102*b*. The pick 101*b* includes an embodiment of a retaining ring 310*b* having an O-ring seal 401. The O-ring seal 401 may comprise a second seal 211*b*. An O-ring 207*b*, which may be a first seal 210*b*, is disposed proximate a distal surface 402 of the holder 102*b* and substantially retains the lubricant 311 in the holder 102*b* between the pick 101*b* and the holder 102*b*. In some embodiments of the invention the O-ring 207*b* proximate the distal surface 402 may form a weeping seal.

FIG. 4 also discloses the hollow portion 209*b* of the shank 202*b* comprising a length 403. In some embodiments the length 403 of the hollow portion 209*b* may be at least as great as the outer diameter of the shank 202*b*. At least part of the volume of the hollow portion 209*b* along length 403 is filled by the lubricant reservoir 312*b*. In addition, the pressurization mechanism 314*b* is disposed in the hollow portion 209*b*, and in one aspect can comprise a closed-cell foam. The hollow portion 209*b* of the shank 202*b* in FIG. 4 can include an opening disposed in the second end 204*b* which is sealed by a filling port 313*b*.

Figure 5:
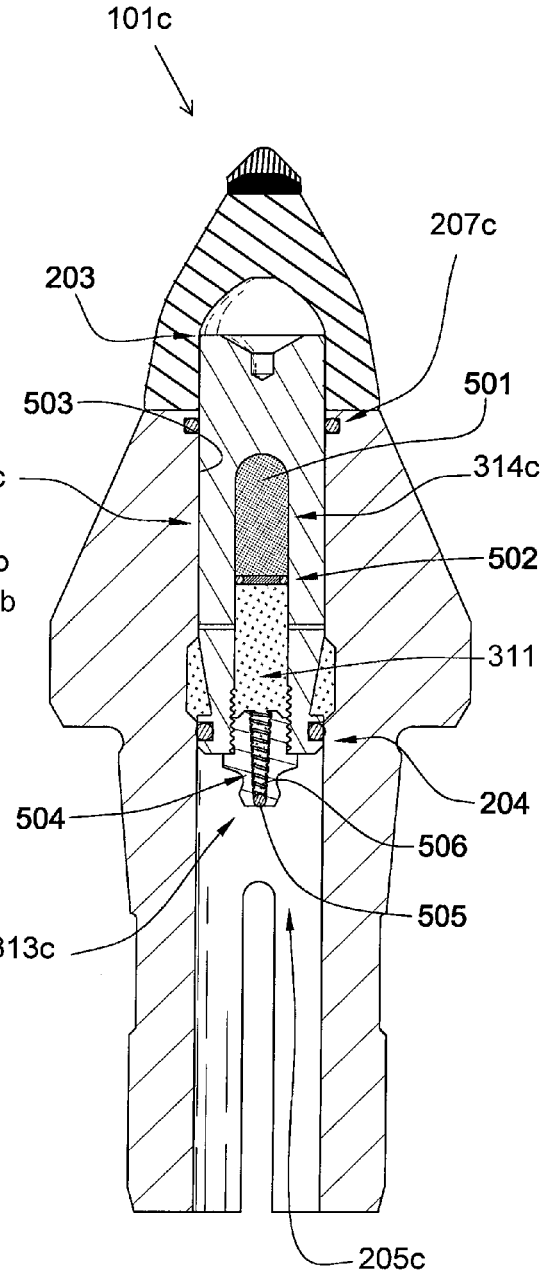
FIG. 5 is a cross-sectional diagram of another embodiment of a high-impact resistant pick.

FIG. 5 discloses another representative embodiment of the degradation pick 101*c* having a shank 202*c* with a tapered geometry proximate the second end 204. In addition, the pressurization mechanism 314*c* disposed in the lubricant reservoir of FIG. 5 comprises a pressurization gas 501 and a reservoir seal 502. Although in the illustrated embodiment 101*c* the pressurization mechanism 314*c* comprises a compressed gas 502, in some embodiments the pressurization mechanism may comprise both a compressed gas and either closed- or open-cell foam. Also disclosed in FIG. 5 is an O-ring 207*c* disposed intermediate the shank 202*c* and an inner surface 503*c* of the central bore 205*c*.

FIG. 5 also discloses an embodiment of a filling port 313*c* that comprises a one-way check valve 504. The check valve 504 in FIG. 5 comprises a ball 505 and a spring 506. When lubricant 311 is forced into the filling port 313*c* the ball 505 and the spring 506 may retract and allow the lubricant 311 to enter the port 313*c* and the lubricant reservoir 312*c*. When lubricant 311 is no longer forced into the filling port 313 the spring 506 may extend the ball 505 and prevent the lubricant 311 from exiting the reservoir 312*c* through the second end 204 of the shank 202*c*.

In FIGS. 3 through 5, each of the pressurization mechanisms may exert a force on the lubricant 311, where the force of the pressurization mechanism is directed toward the second end 204 of the shank. In some embodiments of the invention, the force of the pressurization mechanism may be directed toward the first end 203 of the shank.

Figure 6:
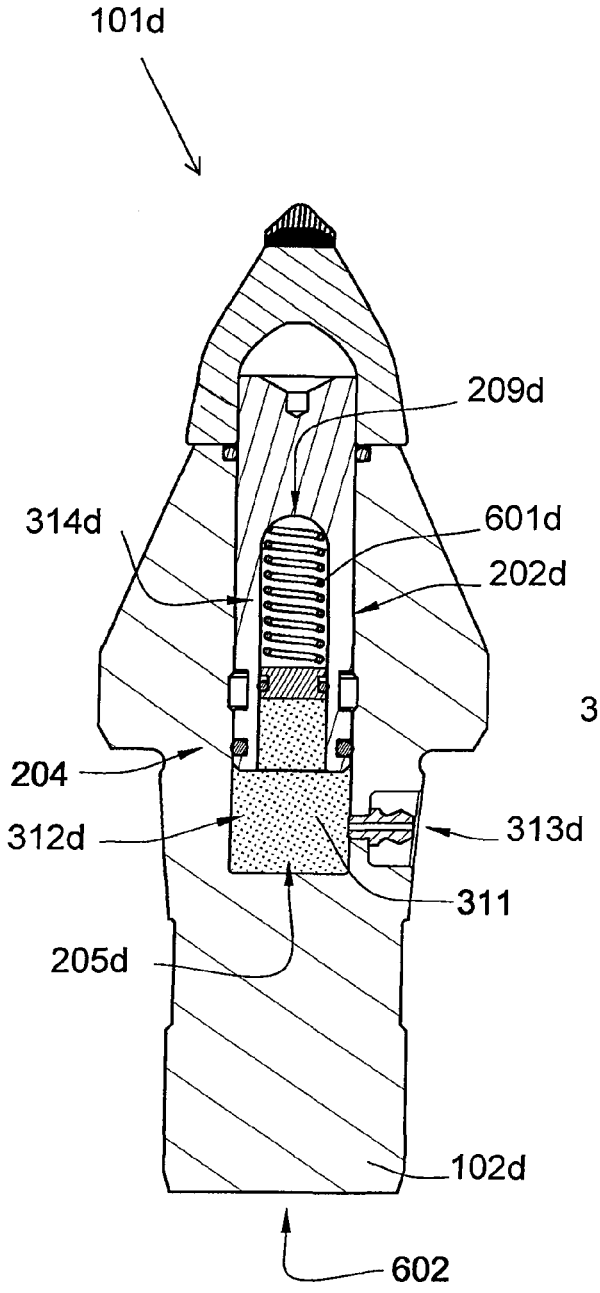
FIG. 6 is a cross-sectional diagram of another embodiment of a high-impact resistant pick.
Figure 7:
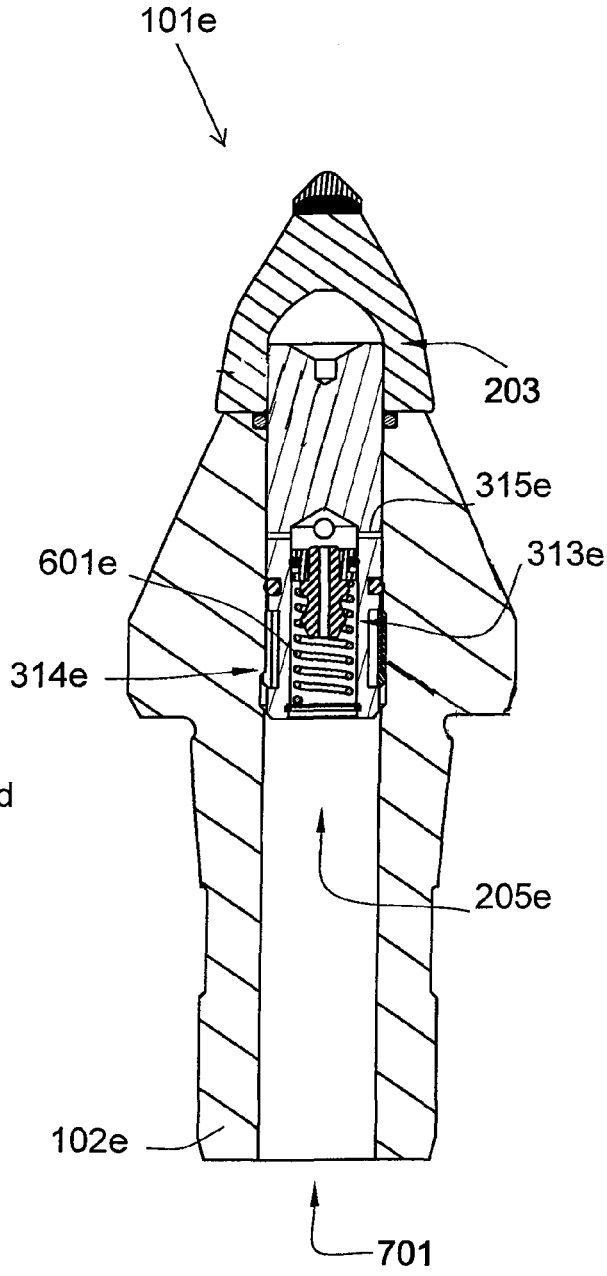
FIG. 7 is a cross-sectional diagram of another embodiment of a high-impact resistant pick.

As can be seen in FIGS. 6 and 7, the pressurization mechanism of the degradation pick can also include a coiled spring. For example, as shown in the degradation pick 101*d* of FIG. 6, the force created by a coiled spring 601*d* of the pressurization mechanism 314*d* can be directed toward the second end 204 so that the mechanism 314*d* compresses the lubricant 311 toward the second end 204. Moreover, the lubricant reservoir 312*d* can also be disposed partially within the hollow portion 209*d* of the shank 202*d* and partially within the central bore 205*d* of the holder 102*d*. The filling port 313*d* can be disposed proximate the shank 202*d*, and the holder 102*d* can have a closed end 602 proximate the driving mechanism.

Alternatively, and as shown in the degradation pick 101*e* of FIG. 7, the coiled spring 601*e* of the pressurization mechanism 314*e* can be configured to compress the lubricant 311 toward the first end 203 so that the lubricant passes through exit pathways 315*e*. Also shown in FIG. 7, the filling port 313*e* may be accessed via an opening 701 of the central bore 205*e*. Such a feature may be advantageous to decrease wear on the filling port 313*e*, especially in applications where easy access to the central bore 205*e* of the holder 102*e* is available.

Figure 8:
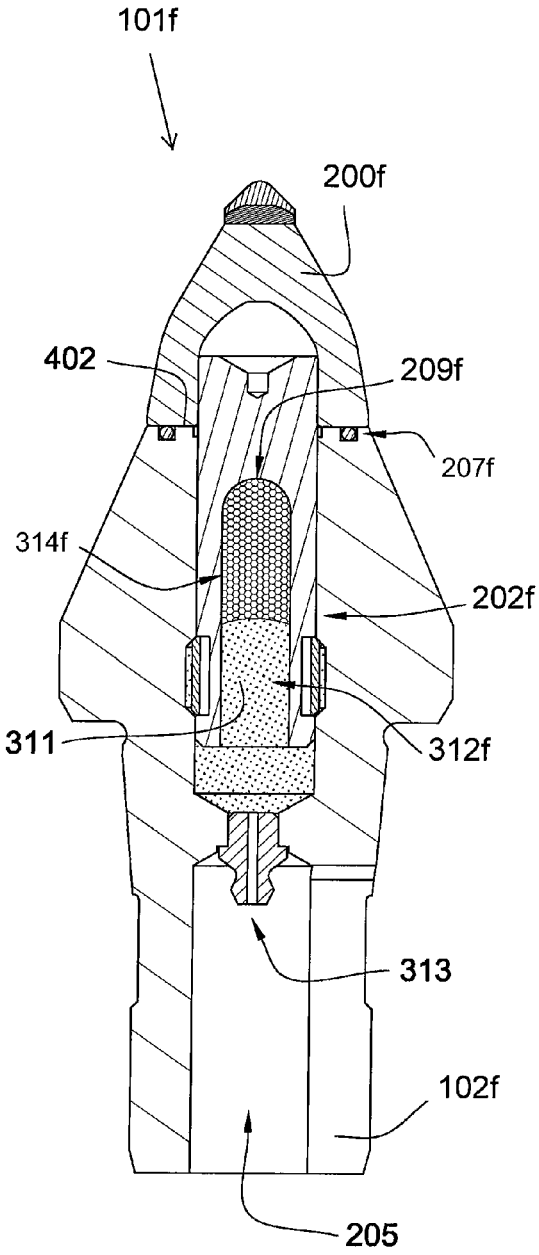
FIG. 8 is a cross-sectional diagram of another embodiment of a high-impact resistant pick.
Figure 9:
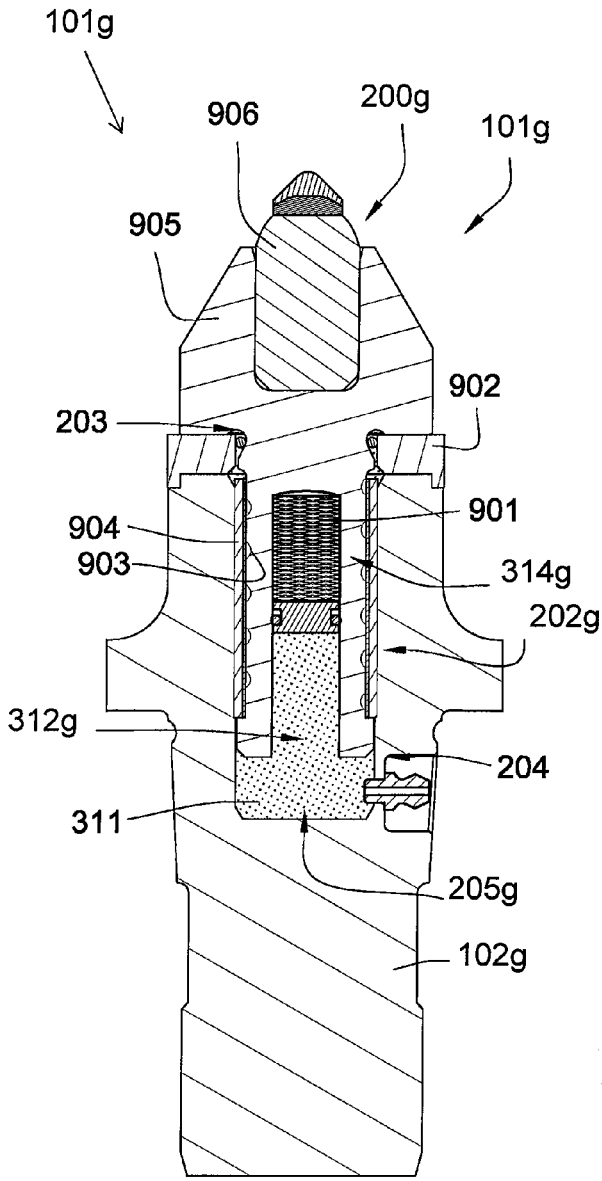
FIG. 9 is a cross-sectional diagram of another embodiment of a high-impact resistant pick.

FIGS. 8 and 9 disclose embodiments 101*f* and 101*g*, respectively, where the lubricant reservoir 312*f*, 312*g* is disposed both within the hollow portion 209*f*, 209*g* of the shank 202*f*, 202*g*, respectively, and within at least part of the central bore 205*f*, 205*g* of the holder 102*f*, 102*g*. In FIG. 8, for example, the pressurization mechanism 314*f* comprises closed cell foam and the degradation pick 101*f* includes an O-ring 207*a* which can be disposed intermediate the bolster 200*f* and the distal surface 402. This embodiment may allow lubricant 311 to lower the friction between the bolster 200*f* and the holder 102*f* as the bolster 200*f* rotates with respect to the holder 102*f*.

In the degradation pick 101*f* illustrated in FIG. 9, the pressurization mechanism 314*g* can include at least one wave spring 901 and a washer 902 that may be radially disposed around the shank 202*g*. The washer 902 intermediate the pick 101*g* and the holder 102*g* may decrease the wear of the pick 101*g*. The washer 902 may be in contact with the holder 102*g* and may be fixed to the holder 102*g*. In some embodiments rotation may occur between the washer 902 and the pick 101*g* during the milling process. The shank 202*g* or central bore 205*g* of the holder 102*g* may comprise grooves 903, which may provide a lubrication path for the lubricant 311. In FIG. 9 the grooves 903 are shown on the shank 202*g* and a bushing 904 is shown intermediate the shank 202*g* and the holder 102*g*. FIG. 9 also discloses an embodiment in which a steel body 905 is disposed intermediate the bolster 200*g* and the first end 203 of the shank 202*g*. In one aspect the bolster 200*g* is a carbide core 906 that is press fit into the steel body 905. In another aspect the core 906 may be brazed to the body 905.

Figure 10:
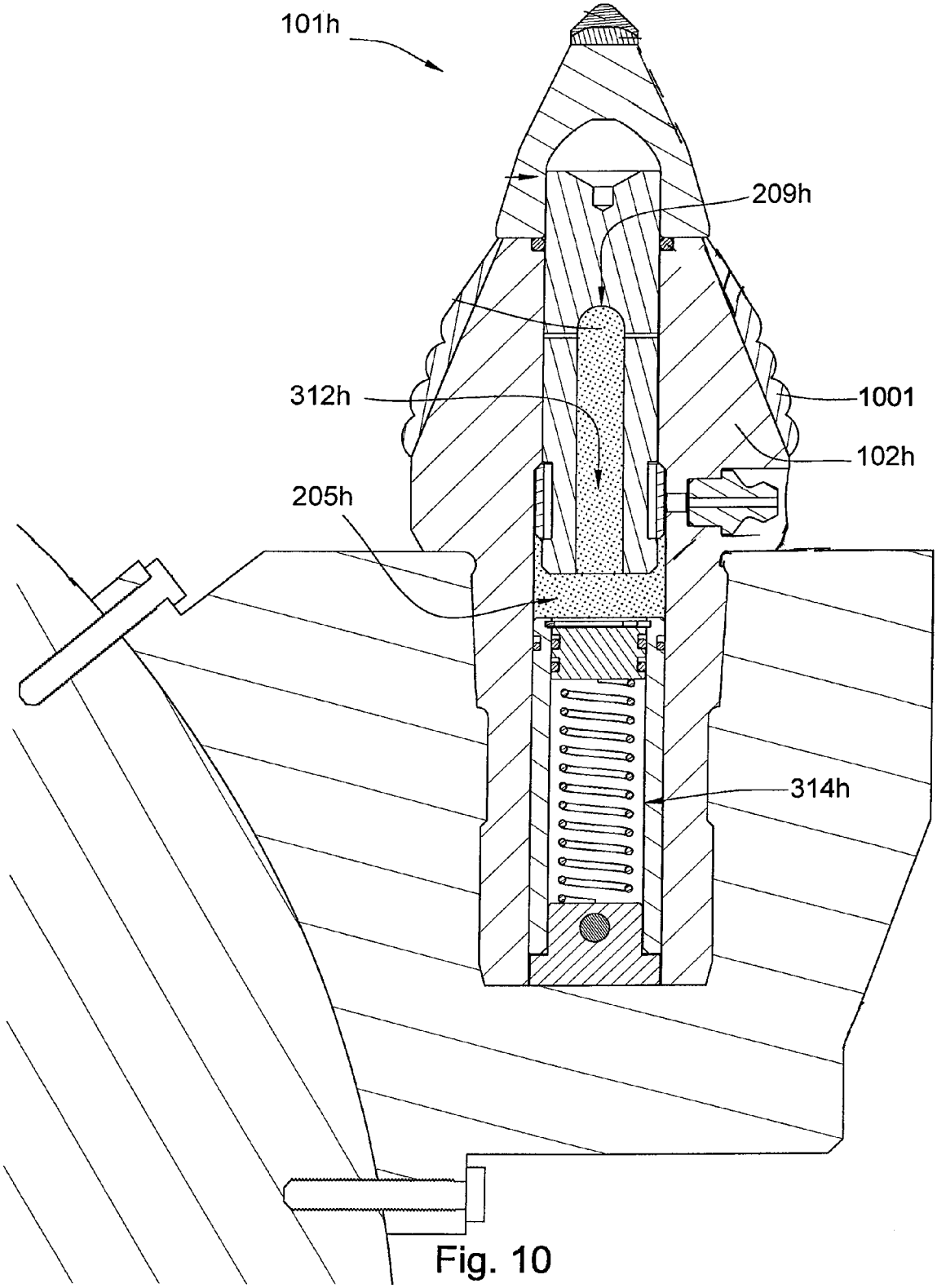
FIG. 10 is a cross-sectional diagram of another embodiment of a high-impact resistant pick.

FIG. 10 discloses another embodiment of the degradation pick 101*h* having a hard material 1001 placed on an exposed surface of an holder 102*h*. The hard material 1001 can include at least one material selected from the group consisting of cobalt-base alloys, copper-base alloys, iron chromium alloys, manganese steel, nickel-base alloys, tool steel, tungsten carbide, and combinations thereof. The hard material 1001 may also be applied to a surface by arc welding, torch welding, or by some other means. Additionally, FIG. 10 further discloses the pressurization mechanism 314*h* being located within the central bore 205*h* of the holder 102*h* and the lubricant reservoir 312*h* being located within the hollow portion 209*h* of the shank 202*h*, with the reservoir 312*h* extending into the central bore 205*h* of the holder 102*h*.

Figure 11:
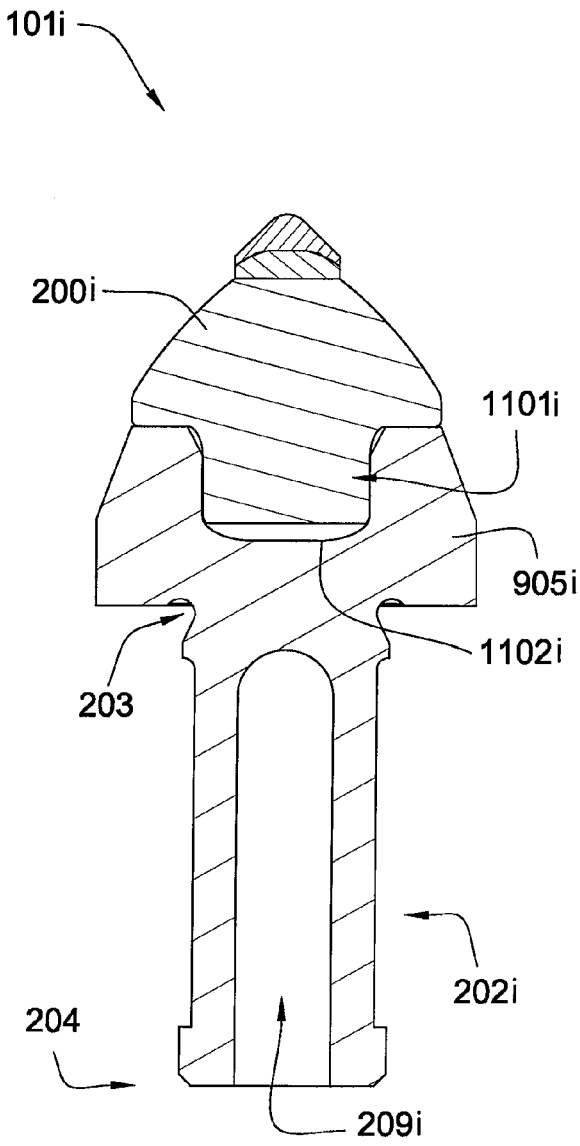
FIG. 11 is a cross-sectional diagram of another embodiment of a high-impact resistant pick.
Figure 12:
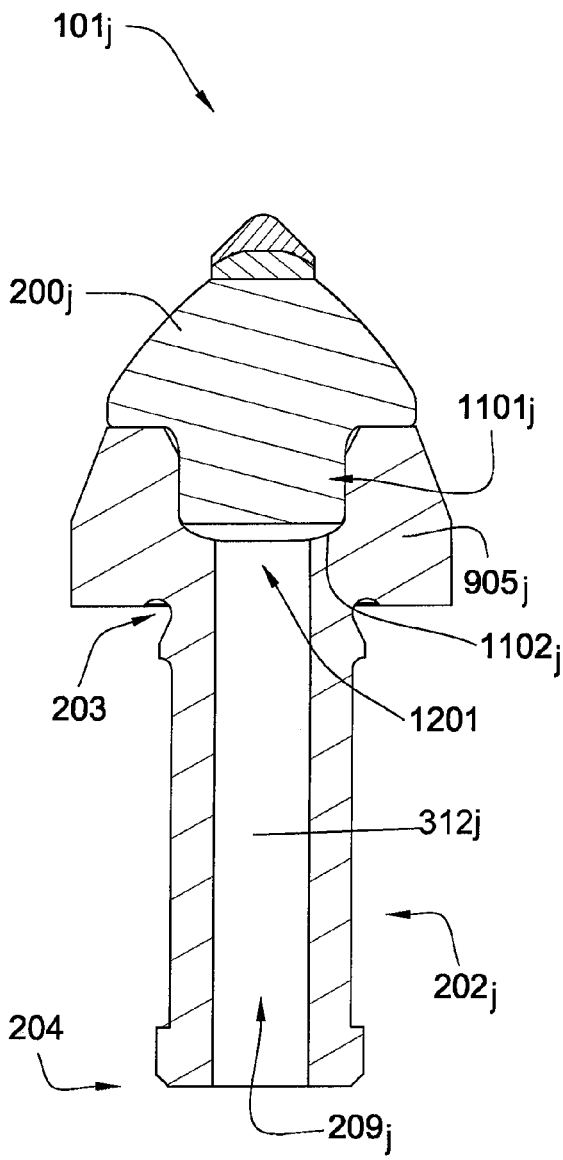
FIG. 12 is a cross-sectional diagram of another embodiment of a high-impact resistant pick.

FIGS. 11 and 12 disclose additional embodiments 101*i* and 101*j*, respectively, where a protrusion 1101*i*, 1101*j* of the bolster 200*i*, 200*j* extends into a socket 1102*i*, 1102*j* of the steel body 905*i*, 905*j*, respectively, and in which the protrusions 1101*i*, 1101*j* may be press fit into the sockets 1102*i*, 1101*j*. In one aspect shown in FIG. 11, the hollow portion 209*i* of the shank 202*i* extends from the second end 204 but does not extend past the first end 203 of the shank 203*i*. In another aspect shown in FIG. 12, however, the hollow portion 209*j* of the shank connects to an aperture 1201 in the steel body 905*j*, and a lubricant reservoir 312*j* may be disposed within both the hollow portion 209*j* and the aperture 1201, and wherein the lubricant reservoir 312*j* may extend from or before the second end 204 and past the first end 203.

Figure 13:
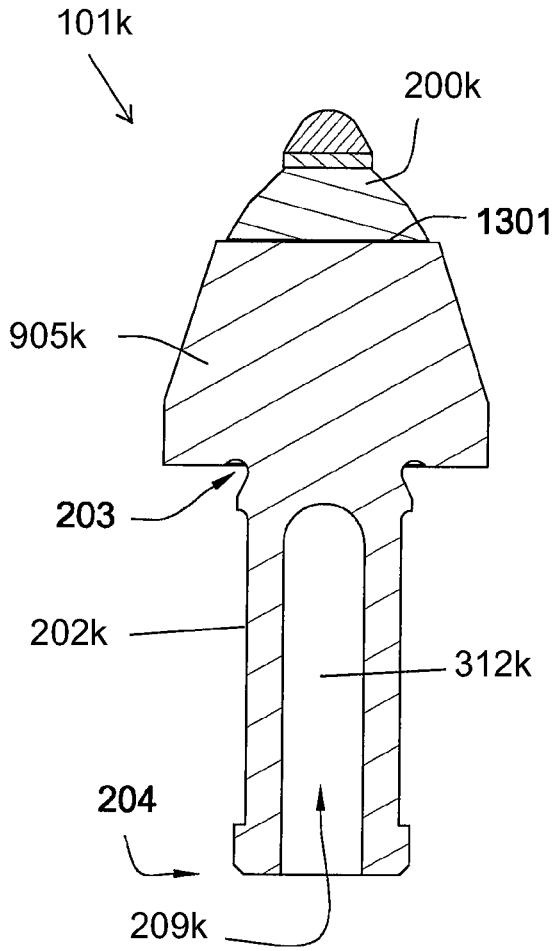
FIG. 13 is a cross-sectional diagram of another embodiment of a high-impact resistant pick.

FIG. 13 discloses another embodiment of the degradation pick 101*k* where the bolster 200*k* is brazed to the steel body 905*k* at a planar interface 1301. In the present embodiment the lubricant reservoir 312*k* may not extend past the first end 203 because the hollow portion 209*k* of the shank 202*k* does not extend past the first end 203. In other embodiments similar to the degradation pick 101*k*, however, hollow portion 209*k* of the shank 202*k* may extend past the first end 203 of the steel body 905*k*, thereby allowing the lubricant reservoir 312*k* to extend past the first end 203 into the steel body 905*k*.

Figure 14:
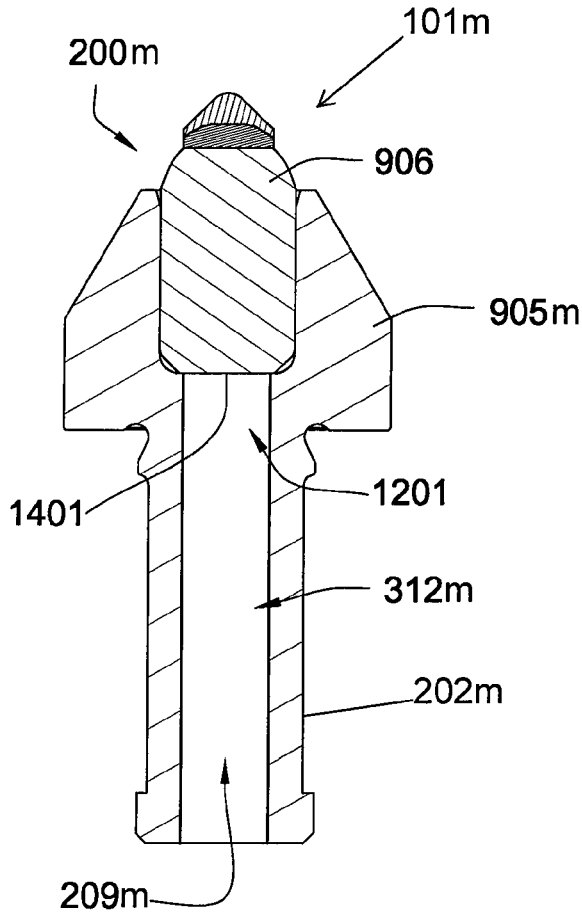
FIG. 14 is a cross-sectional diagram of another embodiment of a high-impact resistant pick.

FIG. 14 discloses yet another embodiment of the degradation pick 101*m* having a bolster 200*m* comprising a carbide core 906 wherein the lubricant reservoir 312 may extend through the hollow portion 209 of the shank 202*m*, into an aperture 1201 in the steel body 905*m*, and may stop at base 1401 of the carbide core 906.

Figure 15:
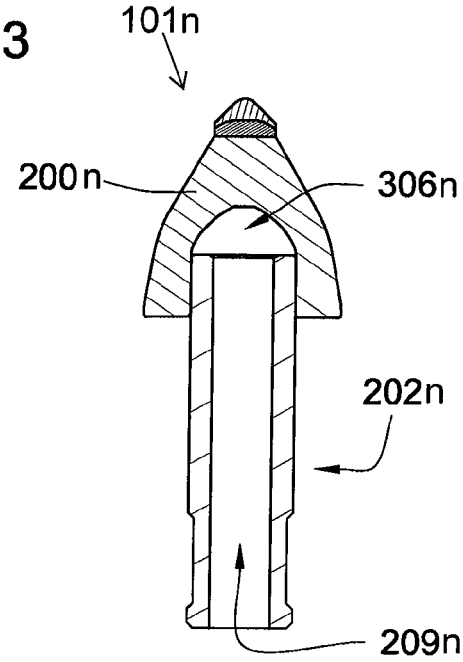
FIG. 15 is a cross-sectional diagram of another embodiment of a high-impact resistant pick.

FIG. 15 discloses another embodiment of the degradation pick 101*n* wherein the hollow portion 209*n* of the shank 202*n* may fluidly connect to the recess 306*n* in the bolster 200*n*. In some embodiments the lubricant reservoir 312*n* may be disposed in both the hollow portion 209*n* and the recess 306*n*. In one application the degradation pick 101*n* may be used in a downhole rotary drill bit or in a horizontal directional drill bit. The degradation pick 101*n* may also be used in trenching machines, or in a mining machine for mining coal or other materials.

Whereas the present invention has been described in particular relation to the drawings attached hereto, it should be understood that other and further modifications apart from those shown or suggested herein, may be made within the scope and spirit of the present invention.

What is claimed is:

1. A degradation pick, comprising:

a bolster disposed intermediate a shank and an impact tip; the shank comprising an outer diameter and first and second ends;

the shank being coupled to the bolster through the first end and the second end being adapted for insertion into a central bore of a holder attached to a driving mechanism; and wherein the shank comprises a hollow portion disposed within the outer diameter and passing longitudinally from the first end to the second end, and further extending longitudinally to distally end at the bolster.

2. The pick of claim 1, wherein the impact tip comprises an impact surface with a hardness greater than 4000 HK.

3. The pick of claim 2, wherein the impact surface comprises a material selected from the group consisting of diamond, polycrystalline diamond, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, cemented metal carbide, chromium, titanium, aluminum, tungsten, or combinations thereof.

4. The pick of claim 1, wherein the pick is part of an asphalt milling machine, a trenching machine, a coal mining machine, or combinations thereof.

5. The pick of claim 1, wherein a steel body is disposed intermediate the first end and the bolster.

6. The pick of claim 5, wherein the bolster is a carbide core that is press fit into the steel body.

7. The pick of claim 5, wherein the steel body is brazed to the bolster.

8. The pick of claim 1, wherein the bolster comprises a cemented metal carbide.

9. The pick of claim 1, wherein a lubricant reservoir is disposed at least partially within the hollow area.

10. The pick of claim 9, wherein the lubricant reservoir is pressurized.

11. The pick of claim 10, wherein the lubricant reservoir comprises a pressurization mechanism selected from the group consisting of springs, coiled springs, foam, closed-cell foam, compressed gas, wave springs, and combinations thereof.

12. The pick of claim 1, wherein the second end of the shank is disposed within a central bore of a holder.

13. The pick of claim 12, wherein the central bore of the holder comprises a removable closed end proximate a driving mechanism.

14. The pick of claim 12, wherein an o-ring is disposed proximate a distal surface of the holder and substantially retains a lubricant within the holder.

15. The pick of claim 14, wherein the o-ring is disposed intermediate the bolster and the distal surface.

16. The pick of claim 14, wherein the o-ring is disposed intermediate the shank and an inner surface of the bore.

17. The pick of claim 1, wherein the outer diameter is between 0.5 and 2 inches.

18. The pick of claim 1, wherein the hollow portion comprises a length that is at least as great as the outer diameter.

19. The pick of claim 1, wherein the hollow portion comprises an opening disposed in the second end.

20. A degradation pick, comprising:

a bolster including:

a bolster distal end having an impact tip; and a bolster proximal end having a protrusion;

a steel body including:

a steel body distal end having a socket, wherein the protrusion of the bolster resides within the socket; and a steel body proximal end having an aperture, wherein the aperture is contiguous with the socket;

a shank including:

a shank distal end connected to the steel body proximal end; and a shank proximal end, wherein a hollow portion located within the shank extends longitudinally from the shank proximal end to the shank distal end, wherein the hollow portion is continuous with the aperture, and wherein a lubricant reservoir resides within the hollow portion and the aperture and extends distally to terminate at a proximal end of the protrusion residing within the socket.

* * * * *